US005737770A

United States Patent [19]

Chen

[11] Patent Number: 5,737,770

[45] Date of Patent: Apr. 14, 1998

[54] SPORT FACE MASK

[76] Inventor: Mike Chien-Fang Chen, 17, Kung 6 Road, Linkou 2nd Industrial Park, Taipei Hsien, Taiwan

[21] Appl. No.: 102,291

[22] Filed: Aug. 5, 1993

Related U.S. Application Data

[63] Continuation-in-part of Ser. No. 907,352, Jul. 1, 1992, abandoned.

[51] Int. Cl.[6] ..... A41D 13/00

[52] U.S. Cl. ..... 2/9

[58] Field of Search ..... 2/9, 10, 11, 15, 2/173, 205, 424, 425

[56] References Cited

U.S. PATENT DOCUMENTS

| | | | |
|---|---|---|---|
| 455,007 | 6/1891 | Rooney | 2/9 |
| 861,170 | 7/1907 | Gamble et al. | 2/9 |
| 881,957 | 3/1908 | Ridlon | 2/9 |
| 2,206,997 | 7/1940 | Austad | 2/9 |
| 2,502,377 | 3/1950 | Goldsmith et al. | 2/9 |
| 2,839,755 | 6/1958 | Steriss | 2/9 |
| 3,216,023 | 11/1965 | Morgan | 2/9 |
| 3,220,014 | 11/1965 | Strohm et al. | 2/9 |
| 3,729,745 | 5/1973 | Latina | 2/9 |
| 4,736,466 | 4/1988 | Kallstrom | 2/9 |
| 5,093,936 | 3/1992 | Copeland et al. | 2/9 |

*Primary Examiner*—Michael A. Neas
*Attorney, Agent, or Firm*—Diller, Ramik & Wight, PC

[57] ABSTRACT

A face mask is provided for protecting a face of the wearer thereof while participating in anyone of a variety of different ball sports, such as hard ball baseball, softball, hockey, or the like and includes a one-piece generally homogeneous framework defined by a front nose, opposite cheek, lower jaw, opposite ear and rear skull parts formed of relatively narrow bars with narrow elongated eyes opening extending generally between the ear parts between upper and lower relatively broad sunshade walls adjacent the rear skull part and the nose part. In situ molded pads of polymeric/copolymeric synthetic plastic material are generally inboard of the framework at the lower jaw part and the rear skull part with the molded pads surrounding at least one narrow bar of the framework to retain the same fixed relative to the framework.

3 Claims, 5 Drawing Sheets

SPORT FACE MASK

CROSS-REFERENCE TO RELATED APPLICATION

This application is a continuation-in-part application of U.S. patent application Ser. No. 07/907,352 in the name of Mike Chien-Fang CHEN filed Jul. 1, 1992, now abandoned, and entitled FACE MASK FOR BASEBALL OR SOFTBALL GAME.

BACKGROUND OF THE INVENTION

The present invention relates to a ball sport face mask, and more particularly to a face mask used in playing or officiating baseball, softball, hockey or the like.

In a baseball or softball game, the catcher and the umpire always wears a face mask, as does a goalie in hockey, which, as shown in FIGS. 1 and 2, takes the form of a framework having a plurality of holes for sight, breath or ventilation, but suffers from the following disadvantages:

1) the wearer is susceptible to be interfered by sunlight coming through the forehead or cheek part of the face mask to result in a catcher's loss or an umpire's misjudgment being detrimental to a smooth or successful game;

2) the face mask includes a plurality of steel rods welded together to be encapsulated in a covering so that its manufacturing procedure is complicated, labor-consuming, material-consuming and not cost-effective; and 3) the face mask is relatively weighty which might be harmful to the wearer's neck.

It is, therefore, attempted by the present invention to deal with the above disadvantages encountered by the prior art.

SUMMARY OF THE INVENTION

It is an object of the present invention to provide a face mask freeing the wearer from being interfered by the sunlight.

It is a further object of the present invention to provide a face mask having a reduced weight and cost and/or capable of being manufactured in a relatively easy manner.

According to the present invention, a face mask being a framework having holes is featured in that there is provided with a sunshade device capable of freeing the wearer from an interference from the sunlight. Such mask can be integrally formed from the engineering plastic.

The sunshade device can include boards respectively provided on the forehead and cheek parts of the mask. The sunshade board on the forehead part can have slits capable of passing therethrough straps of a protective pad.

The face mask of the present invention also preferably includes in situ molded pads of polymeric/copolymeric synthetic plastic material generally inboard of the framework located respectively one at the lower jaw part and another at the rear skull part. Each of the in situ molded pads surrounds at least one narrow bar of its respective lower jaw part and its rear skull part. In this manner, the pads can be quickly and inexpensively secured to the framework by the in situ injection-molding operation which also fixes the pads relative to the framework and locates the same at those areas of a wearer requiring maximum protection.

With the above and other objects in view that will hereinafter appear, the nature of the invention will be more clearly understood by reference to the following detailed description, the appended claims and the several views illustrated in the accompanying drawings.

DETAILED DESCRIPTION OF THE PREFERRED EMBODIMENTS

Figure 1:
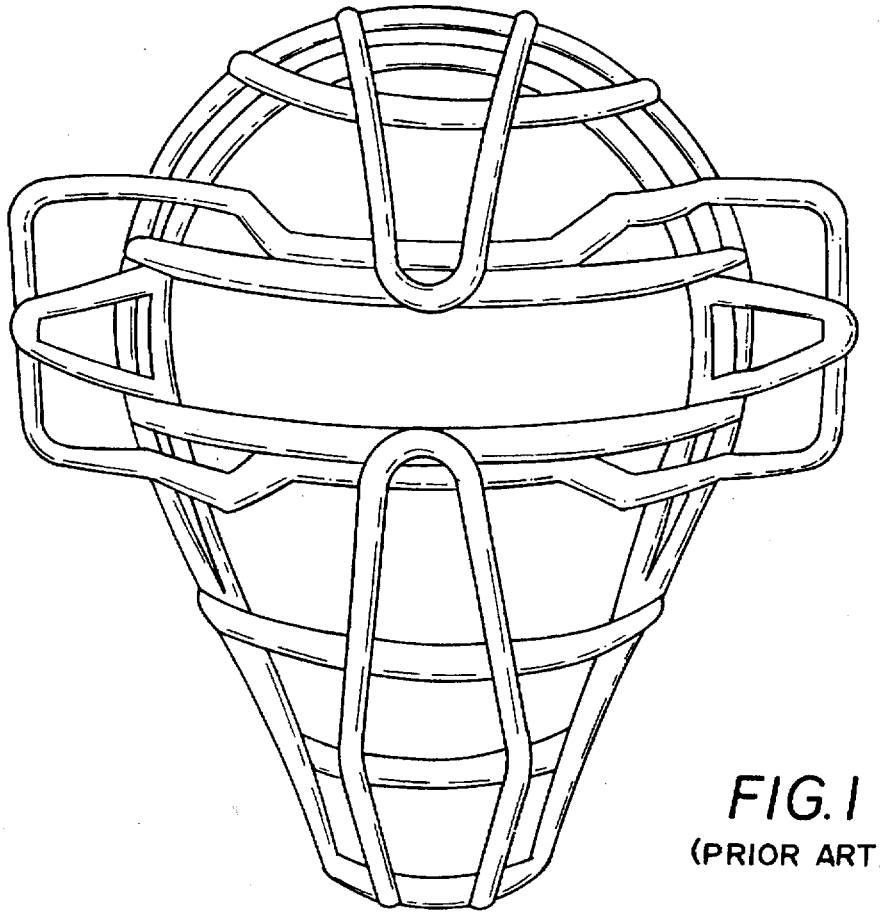
FIG. 1 (PRIOR ART)
FIG. 1 is a front view showing a face mask for a baseball or softball game according to the prior art.
Figure 2:
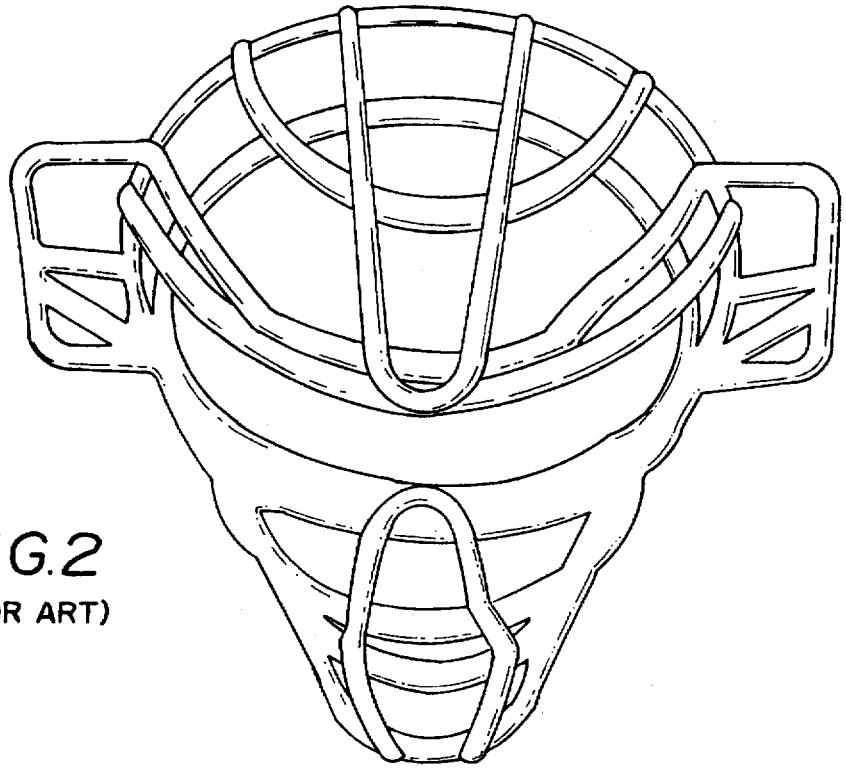
FIG. 2 (PRIOR ART)
FIG. 2 is a top view showing the face mask of FIG. 1.
Figure 3:
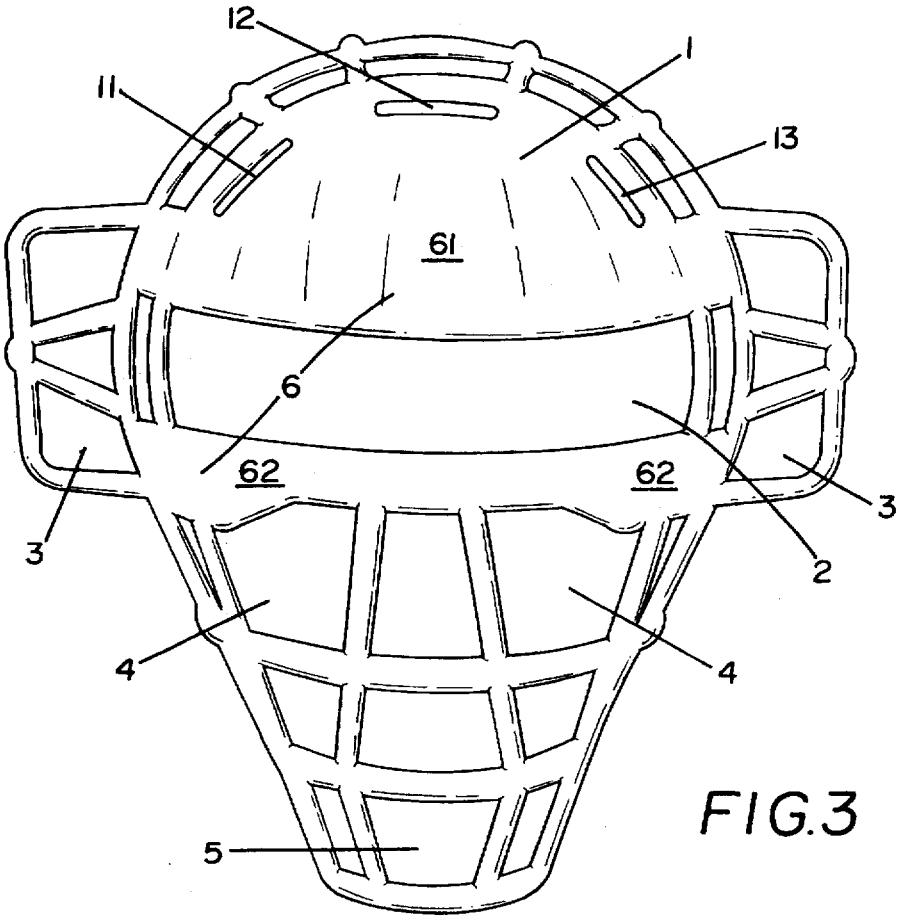
FIG. 3 is a front view showing a face mask for a baseball or softball game according to the present invention.
Figure 4:
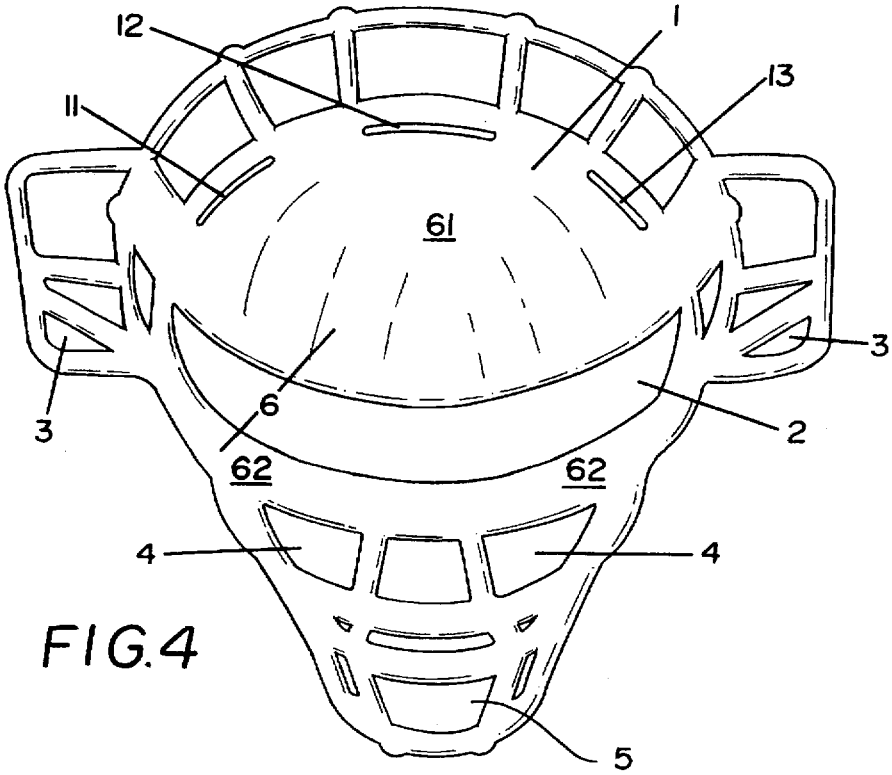
FIG. 4 is a top view showing the face mask of FIG. 3.
Figure 5:
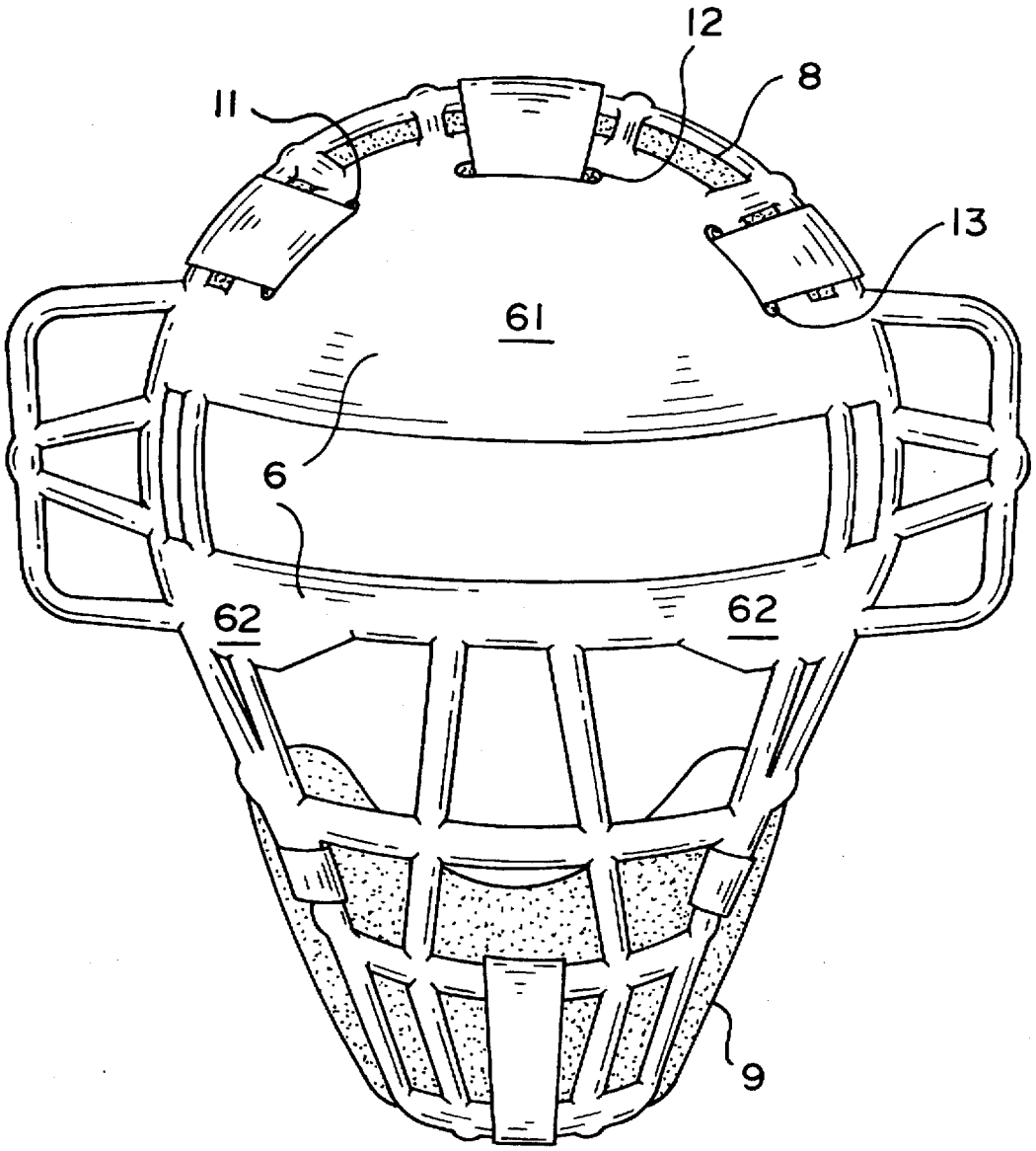
FIG. 5 is a front view showing the face mask of FIG. 3 incorporating thereon protective pads.
Figure 6:
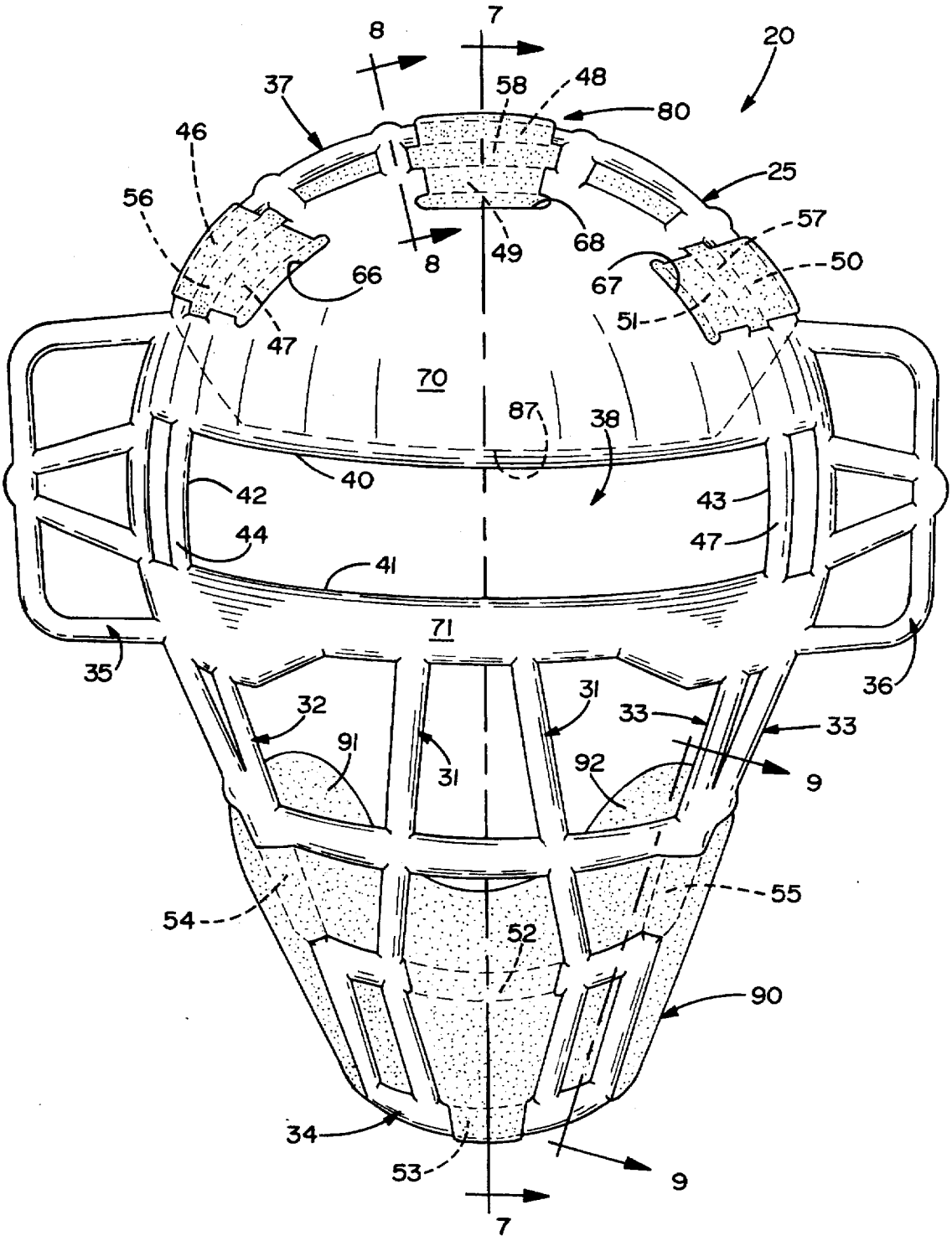
FIG. 6 is a front elevational view of another face mask of the present invention, and illustrates in situ molded pads of polymeric/copolymeric synthetic plastic material generally inboard of the framework located at a rear skull part and a lower jaw part of a framework of the face mask and partially surrounding at least selective ones of narrow bars thereof.

Referring to FIGS. 3 to 5, a preferred embodiment of a face mask for a baseball or softball game according to the present invention being generally in the form of a framework and having a forehead part 1, an eye part 2, an ear part 3, a cheek part 4 and a lower jaw part 5 is featured in that there is provided with a sunshade device 6 capable of freeing the wearer from an interference from the sunlight. Sunshade device 6 can include a first board 61 provided on forehead part 1, and a second board 62 provided on cheek part 4 and can also reinforce the strength of the present face mask. First board 61 can include a plurality of slits 11, 12, 13 capable of passing therethrough straps of a cushioning protective pad 8.

The present face mask is additionally featured in that the framework and sunshade device 6 are integrally formed from the engineering plastic to be seamless. Such face mask has a reduced weight and a sound strength and can be manufactured in a relatively easy manner.

Certainly, the top of the present face mask can also be provided with a sunshade board, if necessary.

Reference is now made to FIGS. 6 through 9 of the drawings which illustrate another novel face mask particularly adapted for use in conjunction with playing softball, hard ball, hockey or the like.

The face mask of FIGS. 6 through 9 is generally designated by the reference numeral 20 and includes a framework 25 of a one-piece generally homogeneous molded plastic construction defined by a front nose part 31 located generally between opposite cheek parts 32, 33, a lower jaw part 34 below the front nose part 31, an ear part 35, 36 adjacent, above and outboard of each cheek part 32, 33, respectively, and a rear skull part 37 spanning the ear parts 35, 36.

A relatively narrow elongated eyes opening 38 is defined by upper generally parallel edges 40, 41 and lateral generally parallel edges 42, 43 defined by respective narrow bars 44, 45. The narrow bars 44, 45 are two of numerous narrow bars defining the overall framework 25, such as pairs of narrow bars 46, 47; 48, 49; and 50, 51 of the rear skull part 37 and generally parallel bars 52, 53 and downwardly converging bars 54, 55 of the lower jaw part 34 (See FIG. 6). Slots 56, 58 and 57 are defined between the pairs of bars 46, 47; 48, 49; and 50, 51, respectively. A slit 66, 68, 67 lies adjacent and is in part defined by each of the bars 47, 49 and 51, respectively.

As in the case of the face mask of FIGS. 3 through 5, the face mask 20 also includes a first relatively broad sunshade wall 70 above the edge 40 of the elongated eyes opening 38 and a second relatively broad sunshade wall 71 below the lower edge 41 of the elongated eyes opening 38.

Figure 8:
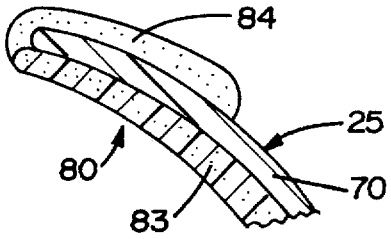
FIG. 8 is a fragmentary cross-sectional view taken generally along line 8—8 of FIG. 6, and illustrates a portion of the in situ molded padding associated with the rear skull part of the framework.
Figure 9:
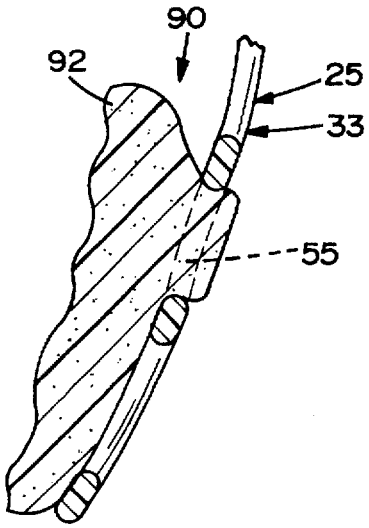
FIG. 9 is a cross-sectional view taken generally along line 9—9 of FIG. 6, and illustrates a portion of the in situ molded padding associated with the lower jaw part.

Also, as in the case of the face mask of FIGS. 3 through 5, the face mask 20 also includes pads or padding generally designated by the reference numerals 80 and 90. The pad or padding 80, 90 is a composition of polymeric/copolymeric synthetic plastic material which is in situ molded in the positions illustrated generally inboard of the framework 20, as is best illustrated in FIGS. 7 through 9 of the drawings with the pad 80 being located generally in the area of the rear skull part 37 and the first broad sunshade wall 70 and the pad 90 being located generally in the area of the lower jaw part 34 with pad portions 91, 92 of the pad 90 projecting upwardly into and adjacent the respective cheek parts 32, 33 of the framework 25.

The pad 80 includes an inboard portion 83 which is relatively thick as compared to an outboard portion 84 to thereby afford maximum protection to the forehead area of the user. The inboard portion 83 and the outboard portion 84 are bridged by intermediate portions 85, 86 which bridge the respective slots or slits 58, 68, respectively, as is best illustrated in FIG. 7. In the latter fashion, the narrow rods 48, 49 are surrounded by the in situ molded pad 80, as are the narrow rods or bars 46, 47 and 50, 51. Thus, in this fashion the pad 80 is accurately and fixedly located to the framework 25 in the area of the rear skull part 37 and the sunshade wall 70 to afford the wearer/user of the face mask optimum protection to the forehead. Preferably, a lower curved edge 87 of the pad 80 terminates short of the edge 40 forming the elongated narrow eyes opening 38.

Figure 7:
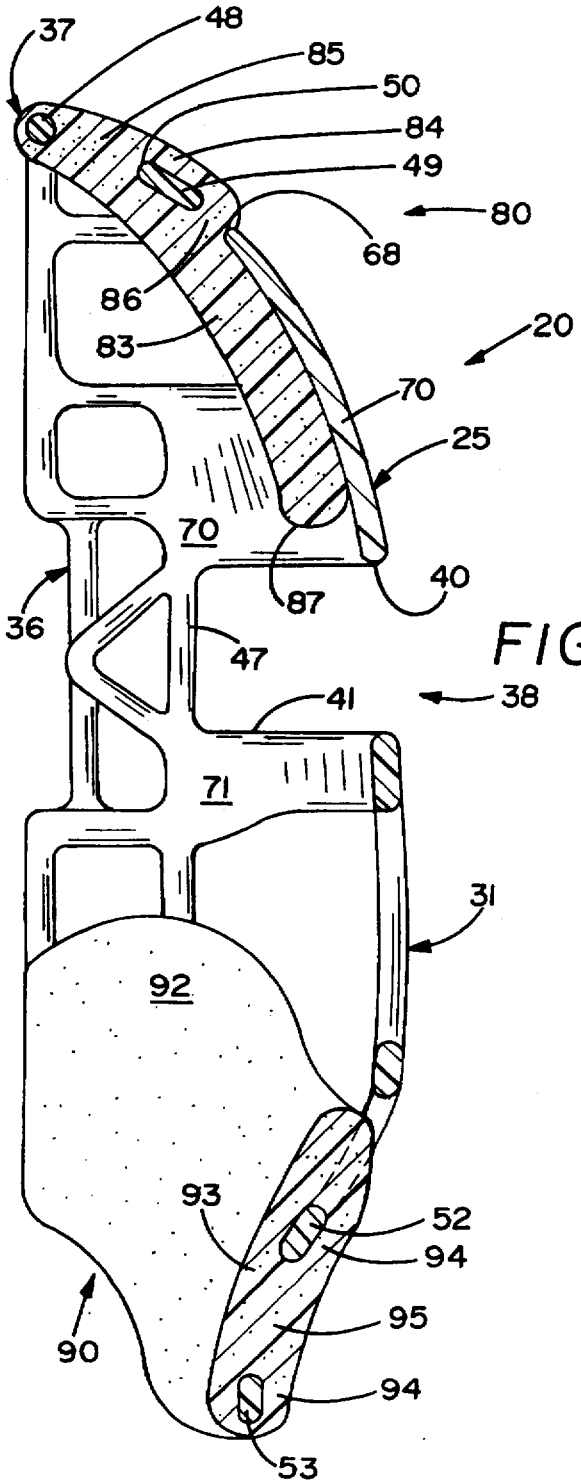
FIG. 7 is a cross-sectional view taken generally along line 7—7 of FIG. 6, and illustrates details of the two in situ molded pads, particularly the manner in which the same are in surrounding relationship to the narrow bars of the framework.

The in situ molded pad 90 similarly includes a thicker inboard pad portion 93 and a thinner outboard pad portion 94 bridged by an intermediate pad portion 95 which spans the slot or slit (unnumbered) between the narrow bars 52, 53, as is best shown in FIG. 7. Thus, the narrow bars 52, 53 are also surrounded by the padding 90, as are the bars 54, 55 (See FIGS. 6 and 9). Therefore, the padding material surrounding the bars 52, 53, 54 and 55 hold the pad 90 fixed and afford accurate and localized protection to the jaw and mouth area of the wearer of the face mask 20.

The pads 80, 90 are in situ molded to the framework 25 after the framework 25 has itself been homogeneously in situ molded by, for example, an injection molding operation in a split mold. After the framework 25 has been thus injection molded, the framework 25 is itself positioned in a mold (not shown) which has a cavity contoured to the mirror image of the framework 25 in those areas in which the polymeric/copolymeric plastic padding material is not to be injected. However, this mold has areas which are essentially mirror images of the padding 80, 90, and when the mold is closed and the plastic is injected therein, these areas fill with plastic to the configuration and construction shown in the drawings resulting in the in situ molded padding 80, 90.

Although a preferred embodiment of the invention has been specifically illustrated and described herein, it is to be understood that minor variations may be made in the apparatus without departing from the spirit and scope of the invention, as defined the appended claims.

What is claimed is:

1. A face mask comprising a one-piece molded plastic framework defined by a front nose part located generally between opposite cheek parts, a lower jaw part below said front nose part, an ear part adjacent above and outboard of each cheek part, and a rear skull part spanning said ear parts; said parts all being formed of relatively narrow bars collectively defining said framework; a relatively narrow elongated eyes opening extending generally between said ear parts; a first relatively broad sunshade wall between an upper edge of said elongated eyes opening and said rear skull part; a second relatively broad sunshade wall beneath a lower edge of said elongated eyes opening, an in situ molded pad of polymeric/copolymeric synthetic plastic material molded generally inboard of and at least in part about said framework located at least at one of said lower jaw part and said rear skull part, another in situ molded pad of polymeric/copolymeric synthetic plastic material molded generally inboard of and at least in part about said framework, said first-mentioned in situ molded pad and said another in situ molded pad being located at a respective one of said lower jaw part and said rear skull part, each of said in situ molded pads at least partially embracing at least one narrow bar of its respective lower jaw part and rear skull part, and each molded pad being of substantially thicker cross-section inboard of said framework as compared to outboard of said framework.

2. The face mask as defined in claim 1 wherein said framework is injection molded.

3. A face mask comprising a one-piece molded plastic framework defined by a front nose part located generally between opposite cheek parts, a lower jaw part below said front nose part, an ear part adjacent above and outboard of each cheek part, and a rear skull part spanning said ear parts; said parts all being formed of relatively narrow bars collectively defining said framework; a relatively narrow elongated eyes opening extending generally between said ear parts; an in situ molded pad of polymeric/copolymeric synthetic plastic material molded generally inboard of and at least in part about said framework located at least at one of said lower jaw part and said rear skull part, another in situ molded pad of polymeric/copolymeric synthetic plastic material molded generally inboard of and at least in part about said framework, said first-mentioned in situ molded pad and said another in situ molded pad are being located at a respective one of said lower jaw part and said rear skull part, each of said in situ molded pads at least partially embrace at least one narrow bar of its respective lower jaw part and rear skull part, and each molded pad being of substantially thicker cross-section inboard of said framework as compared to outboard of said framework.

* * * * *